US009474372B2

(12) United States Patent
Herper

(10) Patent No.: US 9,474,372 B2
(45) Date of Patent: Oct. 25, 2016

(54) APPARATUS FOR CONTROLLING THE MOVEMENT OF A FURNITURE PART AND FURNITURE COMPRISING SUCH AN APPARATUS

(71) Applicant: Grass GmbH & Co. KG, Reinheim (DE)

(72) Inventor: Markus Herper, Muehltal (DE)

(73) Assignee: Grass GmbH & Co. KG, Reinheim (DE)

( * ) Notice: Subject to any disclaimer, the term of this patent is extended or adjusted under 35 U.S.C. 154(b) by 0 days.

(21) Appl. No.: 14/872,380

(22) Filed: Oct. 1, 2015

(65) Prior Publication Data

US 2016/0073781 A1 Mar. 17, 2016

Related U.S. Application Data

(63) Continuation of application No. PCT/EP2014/056899, filed on Apr. 7, 2014.

(30) Foreign Application Priority Data

Apr. 8, 2013 (DE) ..... 20 2013 003 188 U

(51) Int. Cl.
*A47B 88/00* (2006.01)
*A47B 88/04* (2006.01)
(Continued)

(52) U.S. Cl.
CPC ..... *A47B 88/0418* (2013.01); *A47B 88/12* (2013.01); *A47B 88/18* (2013.01); *E05D 15/20* (2013.01); *E05D 15/10* (2013.01); *E05Y 2900/20* (2013.01)

(58) Field of Classification Search
CPC ... A47B 88/0418; A47B 88/12; A47B 88/18
USPC ..... 312/325, 319.1–319.4
See application file for complete search history.

(56) References Cited

U.S. PATENT DOCUMENTS 2,445,131 A * 7/1948 Wartian ..... B64C 1/1407 244/129.5
2,621,097 A * 12/1952 Steinberg ..... A47F 3/005 312/109

(Continued)

FOREIGN PATENT DOCUMENTS

DE 20 20 844 A 12/1971
DE 100 32 897 A1 1/2002

(Continued)

OTHER PUBLICATIONS

German Search Report (Application No. 20 2013 003 188.3) dated Feb. 6, 2014.

(Continued)

*Primary Examiner* — Hanh V Tran
(74) *Attorney, Agent, or Firm* — Burr & Brown, PLLC

(57) ABSTRACT

An apparatus for controlling the movement of a furniture part received movably on a furniture body, including a guide mechanism which acts between the body and the part and with which the part is brought out of a closing state relative to the body, wherein the part is in a position as close as possible to a front side of the body, into an opening state of the part relative to the body, and is moved back into the closing state. In an opening process, the guide mechanism moves the part out of the closing state such that, in a first motion phase, a horizontal distance between the part and the front side of the body increases and, in a subsequent motion phase following the first motion phase, the furniture part is moved linearly onward.

11 Claims, 2 Drawing Sheets

(51) Int. Cl.

| | |
|---|---|
| ***E05D 15/20*** | (2006.01) |
| ***A47B 88/12*** | (2006.01) |
| ***A47B 88/18*** | (2006.01) |
| *E05D 15/10* | (2006.01) |

(56) References Cited

U.S. PATENT DOCUMENTS 3,453,778 A * 7/1969 Daugirdas ..... B61D 19/008 49/214
4,337,596 A * 7/1982 Kern ..... E05D 15/1081 396/517
4,702,514 A * 10/1987 Perry ..... E05D 15/16 296/146.1
5,347,757 A * 9/1994 Losito ..... B61D 19/009 49/130
5,735,080 A * 4/1998 Pratolongo ..... E05D 15/34 312/325
7,845,116 B2 * 12/2010 Masuda ..... E05D 15/1065 49/125
7,849,633 B2 * 12/2010 Oshima ..... E05D 15/1042 49/209
8,950,115 B2 * 2/2015 Andersson ..... E05D 15/1065 312/322
2006/0284530 A1 * 12/2006 Hollenstein ..... E05F 1/1058 312/327
2007/0251519 A1 11/2007 Anikhindi et al.

FOREIGN PATENT DOCUMENTS

DE 20 2011 000 884 U1 7/2012
EP 2 423 417 A2 2/2012
IT WO 2012159784 A1 * 11/2012 ..... E05D 15/1042

OTHER PUBLICATIONS

International Search Report and Written Opinion (Application No. PCT/EP2014/056899) dated Jun. 10, 2014.
International Preliminary Report on Patentability (Application No. PCT/EP2014/056899) mailed Oct. 22, 2015.

* cited by examiner

APPARATUS FOR CONTROLLING THE MOVEMENT OF A FURNITURE PART AND FURNITURE COMPRISING SUCH AN APPARATUS

CROSS REFERENCE TO RELATED APPLICATIONS

This application is a continuation of International Application No. PCT/EP2014/056899 filed Apr. 7, 2014, which designated the United States, and claims the benefit under 35 USC §119(a)-(d) of German Application No. 20 2013 003 188.3 filed Apr. 8, 2013, the entireties of which are incorporated herein by reference.

FIELD OF THE INVENTION

The invention relates to an apparatus for controlling the movement of a furniture part and furniture comprising such an apparatus.

BACKGROUND OF THE INVENTION

In the furniture sector, guide means such as partial extensions, full extensions or furniture hinges are known for enabling a furniture part to be moved relative to a furniture body.

The guide means must meet different requirements; in particular, with the motional guidance, an interior of the furniture body or of the movable furniture part is intended to be made accessible in order to be able to accommodate objects therein or remove them therefrom. Furthermore, the guide means must be able to be accommodated in a space-saving manner.

SUMMARY OF THE INVENTION

The object of the present invention is to better provide guide means for a furniture part received movably on a furniture body, in particular, with regard to a compact accommodation of the guide means on the furniture or a desired relative movement of the furniture part in relation to the furniture body, in order to be able to gain access to a storage space on the furniture.

The invention is based on an apparatus for controlling the movement of a furniture part received movably on a furniture body, wherein the apparatus comprises guide means which act between the furniture body and the furniture part and with which the furniture part can be brought out of a closing state relative to the furniture body, in which the furniture part assumes a position moved as close as possible up to a front side of the furniture body, into an opening state of the furniture part relative to the furniture body, and can be moved back again into the closing state. The moved-close position can be, for instance, a furniture door or furniture flap which is closed or has been swung close up to the furniture body, or a furniture slide-out element inserted into the furniture body.

A first fundamental aspect of the invention lies in the fact that the guide means are configured to move the furniture part, in an opening process, out of the closing state such that, in a first motion phase of the opening process, a horizontal distance of the furniture part to the front side of the furniture body increases and, in a motion phase, following the first motion phase, of the opening process, the furniture part can be moved linearly onward.

In this way, a first motion phase, in which an away movement of the furniture part from the furniture body front is paramount, is advantageously decoupled from a following or second motion phase. The following motion phase is distinguished, in particular, by a greater or substantial distance covered by the furniture part in comparison to a distance covered by the furniture part in the first motion phase. As a rule, the pattern of movement or kinematics of the furniture part of the first and of the following motion phase differ significantly from one another.

In particular, in the first motion phase a rotary movement or a swivel movement of the furniture part can be the critical type of movement, while in the following motion phase a linear or translatory movement can be the sole or critical movement. By the following motion phase should be understood the next or subsequent motion phase in the opening of the furniture part.

Advantageously, with the comparatively short distance covered by the furniture part, during the first motion phase of the furniture part an, in practice, important region in the interior of the furniture body or in an internal volume of the furniture part is accessible to a user of the furniture. This region can, in particular, be such that the appropriate movement of the furniture part is often sufficient for the user and therefore the furniture part is subsequently closed again, with a motional sequence opposite to the first motion phase. This case does not therefore relate to the following movement with respect to the opening process.

In the first opening motion phase, in particular a horizontal distance of a furniture front, which is formed by the movable furniture part, to a front side of the furniture body is increased, the front side of the furniture body being defined, for example, by operating-side end faces of side walls of the furniture body.

In particular, a distance of a rear side of the furniture part to the furniture body, which rear side faces the front side of the furniture body, is increased and, at the same time, is shifted upward, or downward or laterally thereto such that a region on the furniture body which in the closing state of the furniture part was previously concealed is now accessible to the user, and thus usable. Between the first and the following opening motion phase of the furniture part, the furniture part can stand still, or the opening movement runs non-stop and passes seamlessly from the first motion phase into the following motion phase.

The first motion phase can comprise, for example, a swivel movement of the furniture part, or can be solely defined by a swivel movement of the furniture part. The furniture part generally continues to be moved in the following motion phase until a maximum opening state of the furniture part relative to the furniture body is reached. In the following motion phase, the furniture part can solely perform a linear movement, or the linear movement is superimposed throughout the following motion phase, or only over a part of the following motion phase, by another type of movement. On top of this, a partial approaching movement of the furniture part toward the front side of the furniture body, for example, can take place by pivoting.

According to an advantageous variant of the invention, the guide means are configured such that, in the following motion phase of the opening process, that distance of the furniture part to the front side of the furniture body which is reached with the first motion phase does not increase, or at least not substantially. In particular, the distance related to a relevant point on the furniture is not increased. Thus, a necessary minimum distance of the furniture part to further portions of the furniture body can be observed in a space-saving manner. The minimum distance of the furniture part can be defined, for instance, by a contour of an operating handle or handle, protruding on the furniture, on a furniture portion which lies adjacent to the movable furniture part in question and past which at least parts of the furniture part in the opening process, in the first and/or the following motion phase, move. In order to avoid a collision with the protruding contour on the furniture, it is essential not to fall below this minimum distance of the furniture part, at least not related to the point on the protruding contour. Thus the furniture part can be moved in a space-saving manner past further portions of the furniture or of the furniture body in the opening process of the furniture part, in particular without an unnecessarily wide-sweeping movement at the furniture.

A further fundamental aspect of the invention lies in the fact that the guide means comprise a receiving fixture, which is fixedly disposed on the furniture body, and a moving element, which is displaceable thereon and on which the furniture part is shiftably received such that the furniture part can be brought out of the closing state into a disengagement position moved away relative to the front side of the furniture body, and back into the closing state, wherein, in a disengagement position of the furniture part, this is displaceable relative to the furniture body by a displacement of the moving element along the receiving fixture. This is also advantageous with regard to a compact arrangement of the apparatus and accessibility to a usable volume on the furniture. The displacement of the moving element relative to the receiving fixture can be realized exclusively linearly or exclusively non-linearly, for example according to a curved path, or a displacement having both a linear and a non-linear component takes place. A displacement superimposed with a linear and a non-linear movement is also conceivable.

The displacement of the moving element along the receiving fixture can be realized in any chosen disengagement position of the furniture part from the front side of the furniture body. During the displacement of the moving element on the receiving fixture, the disengagement position reached at the start of the displacement can be maintained, or the disengagement position changes in the course of the displacement continuously or, for example, on the first and/or last section of the displacement route. In the course of the displacement, the distance of the disengaged furniture part to the front side of the furniture body can, in particular, diminish, but an increase is also possible.

The distance or the disengagement position of the furniture part during the displacement of the moving element on the receiving fixture can influenced by the shaping of a displacement path configured on the receiving fixture and/or by a simultaneous movement of the furniture part relative to the moving element, for example by pivoting of the furniture part on the moving element, which can be realized during the displacement process of the moving element on the receiving fixture.

In particular, starting from the closing state of the furniture part, if an operator pulls manually on the furniture part, for example on a grip element, in the first motion phase exclusively an away movement of the movable furniture part from the front side of the furniture body will occur, which is realized with the shifting of the furniture part relative to the receiving fixture. The moving element itself in particular remains fixed in a position relative to the receiving fixture in this case. Preferably, the furniture part, in this first motion phase, reaches at the end a maximally moved-away disengagement position of the furniture part relative to the front side of the furniture body.

Subsequently, with or without a time lag to the end of the first motion phase, if the furniture part is intended to be opened further, the displacement of the moving element on the receiving fixture is realized in the following motion phase.

However, an at least occasionally simultaneous movement of the disengagement movement of the furniture part relative to the moving element and of the displacement movement of the moving element along the receiving fixture is also possible, in particular toward the end of the disengagement movement.

An impact can be made on the furniture part by an operator via an appropriate operating element, for example by means of a grip on an operating-side front or front side of the particular furniture part.

Advantageously, the furniture part is received on the moving element shiftably via a swivel arrangement. The furniture part can thus be moved away from the front side in particular in the first motion phase or later moved back closer to the front side. The shift movement of the furniture part relative to the moving element can be realized, for instance, independently from the movement or position of the moving element along the receiving fixture. As a rule, however, configured on the apparatus are control means, with which the shift movement or the shift position of the furniture part relative to the moving element is defined in dependence on the movement or position of the moving element along the receiving fixture. The control means can comprise, for example, a link guide.

With the swivel arrangement, a maximally possible swivel angle or swivel path of the furniture part in relation to the moving element can be limited, in particular via limit means.

Alternatively or on top of the swivel arrangement, another type of guide, such as, for example, a linear guide, can also be realized for the movement of the furniture part on the moving element.

It is also advantageous that the swivel arrangement comprises a lever arrangement. The furniture part can thus be precisely guided and stably moved over an advantageously long working life, even if the furniture part has a comparatively larger weight.

An alternative advantageous variant of the subject of the invention is distinguished by the fact that the swivel arrangement has a four-bar arrangement. A four-bar arrangement can be compactly arranged and is mechanically particularly stable.

Advantageously, the swivel arrangement comprises spring means, which provide a spring force for influencing that swivel process of the furniture part which is possible with the swivel arrangement. The movement can thus be influenced in a purposeful or desired manner, in particular in order to bring the furniture part in the first motion phase securely into the disengagement position. The spring force here supports an initiating force influence by an operator, for instance when the operator moves the furniture part away out of the closing state by pulling in the direction of opening.

Where appropriate, the spring means can also supportingly influence or alone produce a movement of the furniture part relative to the moving element in the direction of the front side of the furniture body.

The spring means form, in particular, an energy store, which, following its discharging, which takes place, for instance, in the course of the disengagement of the furniture part in the first motion phase, is chargeable, for example, by external action on the furniture part by the operator when the furniture part is manually moved onward.

It is also advantageous that the moving element is displaceable on the receiving fixture via a linear guide comprising a rail and thereon acting bearing means. The moving element can thus be displaced on the receiving fixture, in particular in a jerk-free manner via the bearing means.

In particular, it is advantageous that the linear guide comprises a fixed rail on the receiving fixture and rolling elements, which run down said rail, on the moving element. The rail is advantageously present on the receiving fixture with a track or with opposite-situated tracks, on which bearing means, such as, for example, rolling elements, which are received on the moving element, run down or roll. In principle, a reverse arrangement is also possible.

The rail is present on the receiving fixture in particular in perpendicular or vertical or horizontal alignment.

It is advantageous, moreover, that a guideway is configured on the receiving fixture, which guideway is tailored to the swivel arrangement such that the horizontal distance of the furniture part to the front side of the furniture body can be influenced via the guideway in dependence on the displacement position of the moving element along the receiving fixture. Thus, at different displacement positions, the respectively desired disengagement distance of the furniture part to the front side of the furniture body can be set up. At the same time, the furniture part can also be obliquely oriented in relation to a plane perpendicular front side.

For instance, starting from a disengagement distance at the end of the first motion phase or at the beginning of the displacement movement of the moving element, the disengagement distance can be influenced in dependence on the respective displacement position of the moving element.

According to a further advantageous modification of the invention, the receiving fixture comprises a housing, which, in the state inserted on a body wall, forms an outer side region and an opposite inner side region of the particular body wall. Savings can thus be made on body wall material, since the housing replaces portions of a body wall which would otherwise be present. Instead of the fitting of the apparatus on an inner side of the body wall, this inner wall is replaced, in particular in part. Moreover, space can thus be gained within the furniture body, for otherwise, as a result of the apparatus mounted on the inside of the body wall, a space within the furniture body is occupied by the apparatus, in accordance with the thickness or contour of the apparatus.

The invention further relates to a piece of furniture comprising a furniture body and a furniture part which is received movably on the furniture body via guide means with which the furniture part can be brought out of a closing state relative to the furniture body, in which the furniture part assumes a position moved as close as possible up to a front side of the furniture body, into an opening state of the furniture part relative to the furniture body, and can be moved back into the closing state, wherein one of the apparatuses featured above is provided.

In particular, the furniture part is configured as a front flap, wherein, in the first motion phase of the opening process, the front flap can be shifted forward and, where appropriate, at the same time somewhat upward or laterally thereto, so that a lower or lateral region of the furniture body interior is freed from the moved-away furniture part. Thus, already after a first operating action, a part of the inner volume of the furniture body of the furniture body is freely accessible from an operating side. For this, the furniture part advantageously does not have to cover a maximum possible opening path.

BRIEF DESCRIPTION OF THE DRAWINGS

Further features and advantages of the invention are explained in greater detail on the basis of an inventive illustrative embodiment represented in the figures.

DETAILED DESCRIPTION OF THE INVENTION

Figure 2:
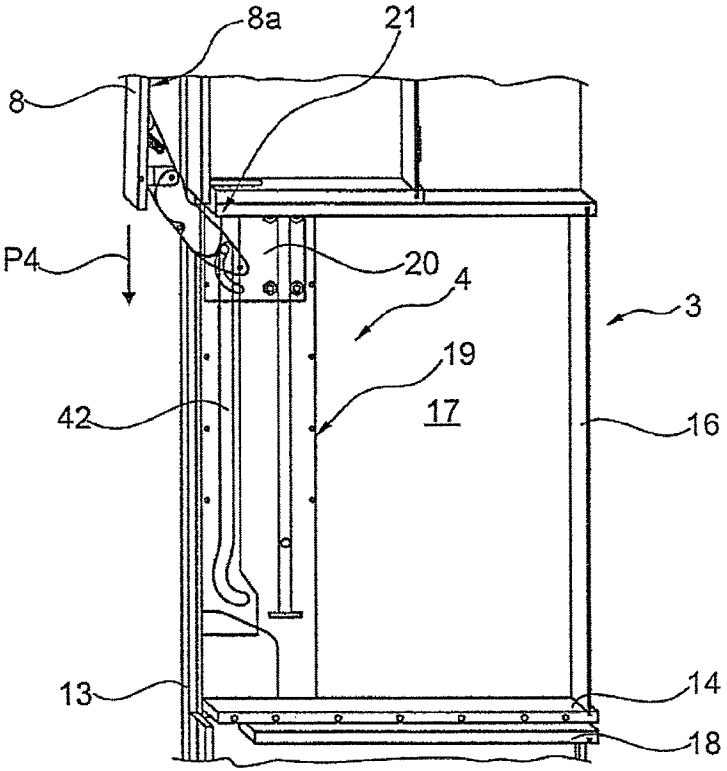
FIG. 2 shows an enlarged view of a detail of the furniture according to FIG. 1 in side view.
Figure 1:
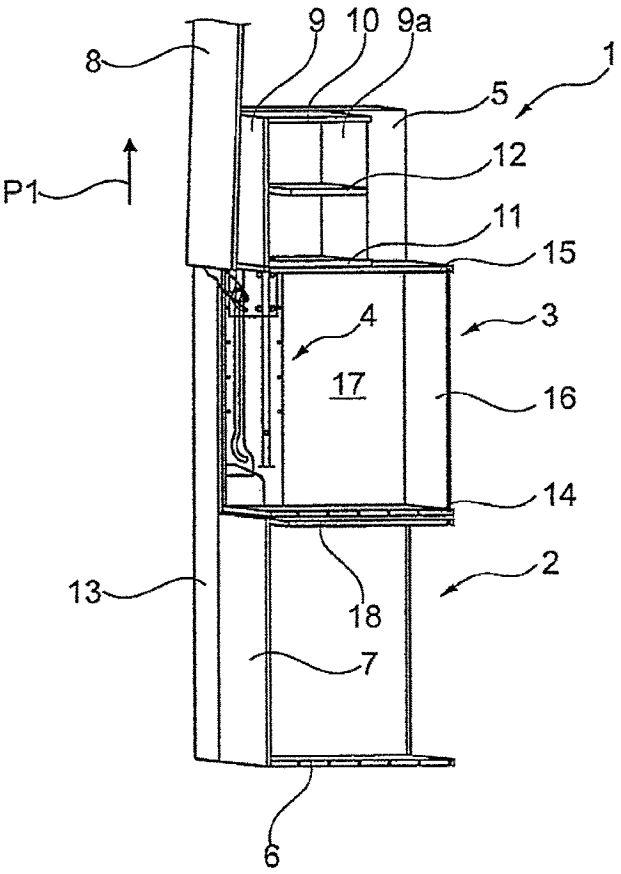
FIG. 1 shows a piece of furniture in perspective view obliquely from the front, with a front element which has been moved away upward via an apparatus according to the invention, wherein a side wall of the furniture is omitted.

FIG. 1 shows a cabinet 1 having a furniture body 2, a side wall of the furniture body 2 having been omitted. Integrated in the cabinet 1, roughly at mid-height, is a part-body 3, on which, on the operating side, a front element 8 guided movably on the furniture body 2 via guide means 4 according to the invention is present, which front element is represented in FIGS. 1 and 2 in a fully opened opening state. Also belonging to the part-body 3 are a cover element 15, a rear wall 16 and a base 14, as well as an inner side wall 17 disposed on the inside of a side wall 5 of the furniture body 2, wherein a thereto parallel, opposite side wall of the part-body 3, having further guide means according to the invention, is likewise not represented.

The cabinet 1 further comprises, related to a direction of view from the front or onto an operating side, the left side wall 5, a base element 6, a lower front element 7, and an upper front element 9 arranged over the middle front element 8. A further, right side wall parallel to the left side wall 5 is omitted in FIGS. 1 to 4 in order that the guide means 4 are visible. Further parts of the cabinet 1 belong to an upper part-body comprising the front element 9, a cover element 10, a base element 11, a middle shelf 12 and a rear wall 9*a*. Furthermore, the furniture body 2 comprises a lateral, fixedly positioned front element 13 extending in a strip shape over the entire height of the cabinet 1.

The front element 7 additionally covers over, from the front, a cover element 18 which is present beneath, adjacent to the base 14.

The front element 8 is hence movable on the side wall 17 via the guide means 4 and on the opposite side wall of the part-body 3 via the corresponding guide means (not represented), so that the front element 8 is guided on both sides.

The represented detail according to FIG. 2 shows the front element 8, which has been moved away maximally upward and the inner side 8*a* of which, in a lower region, is acted on by the guide means 4. The guide means 4 comprise a receiving fixture 19, which is arranged substantially in a strip shape on the side wall 17, and a, in plan view, rectangular moving element 20, which is received displaceably on the receiving fixture 19 and to which the front element 8 is linked via a swivel arrangement 21. The front element 8 is received on the moving element 20 shiftably via the swivel arrangement 21 according to the motion arrow P2, wherein the motion arrow P2 indicates the movement of a bottom edge 8*b* of the front element 8, in a first motion phase of the opening process, out of the closing state according to FIG. 3.

The swivel arrangement 21 comprises a four-bar arrangement 22 comprising a lower pivot lever 23 and an upper pivot lever 24. Each of the two pivot levers 23, 24 is articulately connected by one end to a fitting 25 fixedly arranged on the inner side 8*a* of the front element 8 via a joint 26 and joint 28 respectively, and by the other end, facing away from the front element 8, articulately to the moving element 20 via a joint 27 and joint 29 respectively. The lower pivot lever 23 hence forms the joints 26 and 27, and the upper pivot lever 24 the joints 28 and 29 of the four-bar arrangement 22. Also acting between the upper pivot lever 24 and the fitting 25 is an energy store, configured as a helical spring 30, for influencing the swivel movement of the front element 8 relative to the moving element 20.

Moreover, between the lower pivot lever 23 and the moving element 20, for a specification of a desired swivel motion with the swivel arrangement 21, a link guide 31 comprising a pin 32 and a curved guideway 33 is configured on the moving element 20. The pin 32 protrudes laterally on the lower pivot lever 23 and engages in the guideway 33. The lower pivot lever 23 thus pivots in the first motion phase from the closing state represented according to FIG. 3 into the partially opened position of the front element 8, which position is represented according to FIG. 4 at the end of the first motion phase. This is realized under an external action, for example by a person pulling obliquely forward and upward on a grip (not represented] on the outside of the front element 8. The pin 32 does not here travel as far as the end of the guideway 33, but rather, only upon further displacement of the moving element 20, upward into the opening state represented according to FIG. 2, in which the pin 32 is then in situ at the end of the guideway 33.

Figure 4:
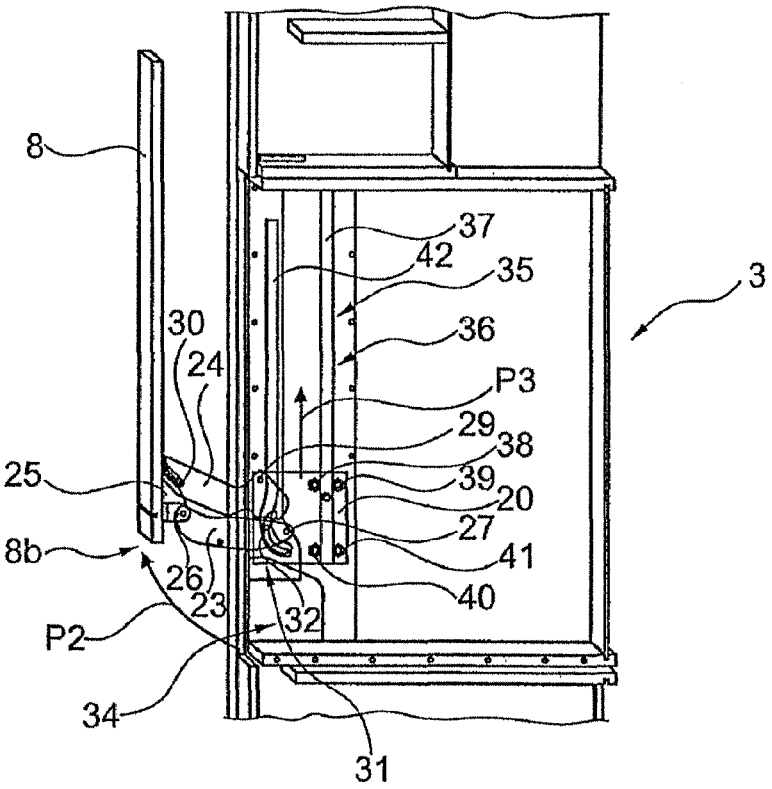
FIG. 4 shows the detail according to FIG. 2 with the front element in a partially opened state.

With the action of the helical spring 30, the resting or closing position represented according to FIG. 4 is securely attained and held, so that a lower region 34 on the part-body 3 is reachable for an operator from the operating side.

If, starting from the partially opened state according to FIG. 4, the front element 8 is now pushed upward, then the front element 8, according to a predefined guidance of the moving element 20 on the receiving fixture 19, moves upward. The movement of the moving element 20 upward in the direction of the motion arrow P3 is realized via displacement means 35. The displacement means 35 comprise a linear guide 36 having a rail 37, here configured in perpendicular orientation, on the receiving fixture 19. On the rail 37, on both sides thereof, roll rolling or bearing means 38 to 41, which are attached to the moving element 20.

Furthermore, a further link guide having a guideway 42 is also present on the receiving fixture 19 in perpendicular direction throughout the vertical movement of the moving element 20. The pin 32 engages in the guideway 42, the swivel movement of the lower lever 23 being defined also with the guideway 42. The guideway 42, which with respect to the first motion phase of the front element 8 runs in a forwardly bent course during the opening process, is shaped in accordance with the guideway 33, so that, as described above, the lower lever 23 is pivotable in the first motion phase. The straight course of the guideway 42 which follows on above has the effect that, when the front element 8 is pushed up out of the state shown according to FIG. 4, the front element 8 is pivoted by a short distance toward the part-body 3, since the pin 32 is forced somewhat in the inward direction under the effect of the helical spring 30.

For the closing of the front element 8 out of the completely opened situation, represented according to FIG. 2, relative to the furniture body 2 or to the part-body 3, the front element 8 is moved by an operator downward according to the arrow P4.

Figure 3:
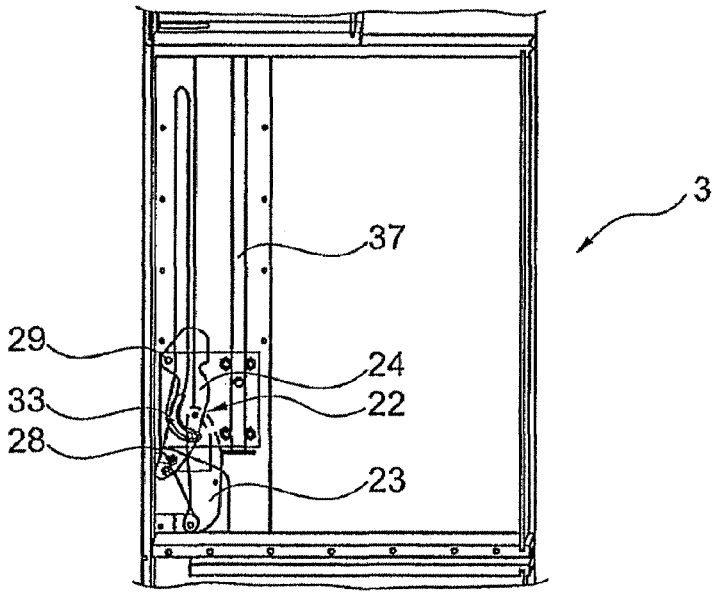
FIG. 3 shows the detail according to FIG. 2 in the fully closed closing state of the front element.

The front element 8 thus regains the completely closed position relative to the part-body 3 according to FIG. 3, wherein the front element 8 is moved back completely up to the front side of the part-body 3, which motion, conversely corresponding to the opening motion, is predefined via the link guide 31 and the guideway 42 with the therein engaging pin 32.

REFERENCE SYMBOL LIST

1 cabinet
2 furniture body
3 part-body
4 guide means
5 side wall
6 base element
7, 8 front element
8*a* inner side
8*b* bottom edge
9 front element
9*a* rear wall
10 cover element
11 base element
12 middle shelf
13 front element
14 base
15 cover element
16 rear wall
17 side wall
18 cover element
19 receiving fixture
20 moving element
21 swivel arrangement
22 four-bar arrangement
23, 24 pivot lever
25 fitting
26-29 joint
30 helical spring
31 link guide
32 pin
33 guideway
34 region
35 displacement means
36 linear guide
37 rail
38-41 bearing means
42 guideway

The invention claimed is:

1. An apparatus for controlling the movement of a furniture part received movably on a furniture body, wherein the apparatus comprises:

guide means which act between the furniture body and the furniture part and with which the furniture part is brought out of a closing state relative to the furniture body, where the furniture part is in a position located as close as possible to a front side of the furniture body, into an opening state of the furniture part relative to the furniture body, and is moved back again into the closing state, wherein in an opening process, the guide means move the furniture part out of the closing state such that, in a first motion phase of the opening process, a horizontal distance between the furniture part and the front side of the furniture body increases, and in a subsequent motion phase following the first motion phase of the opening process, the furniture part is moved linearly onward, wherein the guide means comprise a receiving fixture that is fixedly disposed on the furniture body, and a moving element that is displaceable thereon and on which the furniture part is shiftably received via a swivel arrangement so that during the first motion phase, the furniture part is brought out of the closing state and into a disengagement position, moved away relative to the front side of the furniture body, and back into the closing state, wherein in the disengagement position of the furniture part, the furniture part is further displaceable relative to the furniture body by a displacement of the moving element along the receiving fixture.

2. The apparatus as claimed in claim 1, wherein the guide means are configured such that, in the following motion phase of the opening process, that the horizontal distance between the furniture part to and the front side of the furniture body which is reached with the first motion phase does not substantially increase.

3. The apparatus as claimed in claim 1, wherein the swivel arrangement comprises a lever arrangement.

4. The apparatus as claimed in claim 1, wherein the swivel arrangement has a four-bar arrangement.

5. The apparatus as claimed in claim 1, wherein the swivel arrangement comprises spring means that provide a spring force that influences the swivel process of the furniture part by the swivel arrangement.

6. The apparatus as claimed in claim 1, wherein the moving element is displaceable on the receiving fixture via a linear guide comprising a rail and thereon acting bearing means.

7. The apparatus as claimed in claim 6, wherein the linear guide comprises a fixed rail on the receiving fixture and rolling elements, which run down the rail, on the moving element.

8. The apparatus as claimed in claim 1, wherein a guideway is configured on the receiving fixture, and wherein the guideway is tailored to the swivel arrangement so that the horizontal distance between the furniture part to and the front side of the furniture body is influenced via the guideway dependent upon the displacement position of the moving element along the receiving fixture.

9. The apparatus as claimed in claim 1, wherein the receiving fixture comprises a housing, which, in the state inserted on a body wall, forms an outer side region and an opposite inner side region of the particular body wall.

10. A piece of furniture comprising:

a furniture body and a furniture part which is received movably on the furniture body via guide means with which the furniture part is brought out of a closing state relative to the furniture body, where the furniture part is in a position located as close as possible to a front side of the furniture body, into an opening state of the furniture part relative to the furniture body, and is moved back into the closing state; and the apparatus according to claim 1.

11. An apparatus for controlling the movement of a furniture part received movably on a furniture body, wherein the apparatus comprises guide means which act between the furniture body and the furniture part and with which the furniture part is brought out of a closing state relative to the furniture body, where the furniture part is in a position located as close as possible to a front side of the furniture body, into an opening state where the furniture part is spaced a distance away from the furniture body, and is moved back again into the closing state, and wherein the guide means comprise a receiving fixture that is fixedly disposed on the furniture body, and a moving element that is displaceable thereon and on which the furniture part is shiftably received via a swivel arrangement so that the furniture part is brought out of the closing state into a disengagement position, moved away relative to the front side of the furniture body, and back into the closing state, and wherein in the disengagement position of the furniture part, the furniture part is displaceable relative to the furniture body by a displacement of the moving element along the receiving fixture.

* * * * *